United States Patent [19]

Schäfer et al.

[11] 4,243,390

[45] Jan. 6, 1981

[54] PROCESS FOR DYEING OR PRINTING FIBROUS MATERIAL USING QUATERNARY POLYMERIZED AMMONIUM SALTS AS ASSISTANTS

[75] Inventors: Paul Schäfer, Riehen; Hans-Ulrich Berendt, Allschwil; Jaroslav Haase, Riehen, all of Switzerland

[73] Assignee: Ciba-Geigy Corporation, Ardsley, N.Y.

[21] Appl. No.: 107,115

[22] Filed: Dec. 26, 1979

[30] Foreign Application Priority Data

Dec. 29, 1978 [CH] Switzerland ..... 13278/78

[51] Int. Cl.[3] ..... C09B 67/00; D06P 1/62

[52] U.S. Cl. ..... 8/553; 8/554

[58] Field of Search ..... 8/92, 172 R, 85 R

[56] References Cited

U.S. PATENT DOCUMENTS

| | | | |
|---|---|---|---|
| 2,740,687 | 4/1956 | Ham | 8/511 |
| 2,861,863 | 11/1958 | Schuster et al. | 8/74 |
| 3,940,247 | 2/1976 | Sthare et al. | 8/92 |
| 4,036,587 | 7/1977 | Wolf et al. | 8/92 |
| 4,095,942 | 6/1978 | Dellian et al. | 8/92 |
| 4,131,422 | 12/1978 | Thomas et al. | 8/481 |

FOREIGN PATENT DOCUMENTS

| | | |
|---|---|---|
| 2604910 | 8/1976 | Fed. Rep. of Germany . |
| 855028 | 11/1960 | United Kingdom . |
| 1092965 | 11/1967 | United Kingdom . |

OTHER PUBLICATIONS

G. D. Jones and S. J. Goetz, J. Polymer Science, 1957, 25, 201–215.

M. E. Dullaghan and A. J. Ultee, Textile Research J., 1973, 43, (No. 1), 10–18.

*Primary Examiner*—A. Lionel Clingman

*Attorney, Agent, or Firm*—Edward McC. Roberts

[57] ABSTRACT

A process for dyeing or printing organic fibrous material made e.g. of polyamide, polyester or polyacrylonitrile, and also of cellulose, said process comprising the use of a dyeing or printing assistant which contains a quaternary ammonium salt. The salt is a reaction product of a copolymer of maleic anhydride and ethylene, propylene or styrene, with a N,N-disubstituted n-alkylenediamine, a homopolymer of a vinylpyridine, or a quaternized copolymer of a vinylpyridine and styrene. The reaction product, the homopolymer, and the copolymer are quaternized with e.g. benzyl chloride. The ammonium salt can also be a homopolymer of a vinylbenzyl chloride which is quaternized with a tertiary monoamine. The fibrous material dyed or printed with e.g. direct or disperse dyes or with cationic dyes has excellent levelness, good penetration of the dye, and good wetfastness properties. It is also possible to obtain multi-shade effects by printing the material patchwise with a reserve paste and then dyeing it.

18 Claims, No Drawings

PROCESS FOR DYEING OR PRINTING FIBROUS MATERIAL USING QUATERNARY POLYMERIZED AMMONIUM SALTS AS ASSISTANTS

The present invention relates to a process for dyeing or printing organic fibrous material using a dyeing or printing assistant which contains, as quaternary ammonium salt, (a) a reaction product of a copolymer of maleic anhydride and ethylene, propylene or styrene, with a N,N-disubstituted 1,2-ethylenediamine or 1,3-propylenediamine, wherein each of the substituents is alkyl of 1 to 4 carbon atoms or together with the nitrogen atom form a 5- or 6-membered ring which optionally contains an oxygen atom as second heteroatom, (b) a homopolymer of a 4-vinylpyridine which is unsubstituted or substituted at a ring carbon atom by methyl or ethyl, (c) a copolymer of the above vinylpyridine and styrene, and said reaction product (a), said homopolymer (b) and said copolymer (c) are each quaternised with an alkyl or alkenyl halide containing at least 6 carbon atoms alone, or with at least one halomethylnaphthalene, halomethyldiphenyl, chloroacetamide, chloroacetonitrile, or with a haloacetic acid or an alkali metal salt or alkyl ester of haloacetic acid containing 1 to 12 carbon atoms in the alkyl moiety, or with a benzyl halide which is unsubstituted or substituted by halogen, methyl or ethyl, optionally in admixture with each other or with an alkyl or alkenyl halide containing a maximum of 4 carbon atoms, or (d) a homopolymer of a 2- or 4-vinylbenzyl chloride which is quaternised with a tertiary monoamine containing a maximum of 20 carbon atoms, whilst two substituents of the monoamine are each alkyl of 1 to 4 carbon atoms or together with the nitrogen atom form a 5- or 6-membered ring which may additionally contain an oxygen atom, and the third substituent of the monoamine is alkyl, alkenyl or aryl containing a maximum of 18 carbon atoms which is unsubstituted or substituted by alkyl or alkylene.

Thhe present invention also relates to the use of components (a), (b), (c) or (d) as dyeing or printing assitants, as well as to the fibrous material which is dyed or printed by the process of the invention.

Preferred assistants employed in the process of the invention contain, as quaternary ammonium salt, either (a) a reaction product of a copolymer of maleic anhydride and ethylene, propylene or styrene, with a N,N-disubstituted 1,2-ethylenediamine or 1,3-propylenediamine, wherein each of the substituents is alkyl of 1 to b 4 carbon atoms or together with the nitrogen atom form a 5- or 6-membered ring which optionally contains an oxygen atom as second heteroatom, or (b) a homopolymer of a 4-vinylpyridine which is unsubstituted or substituted at a ring carbon atom by methyl or ethyl, and said reaction product (a) and said homopolymer (b) are each quaternised with at least one halomethylnaphthalene, halomethyldiphenyl, chloroacetamide, chloroacetonitrile or with a benzyl halide which is unsubstituted or substituted by halogen, methyl or ethyl, optionally in admixture with each other or with an alkyl or alkenyl halide containing a maximum of 4 carbon atoms. Suitable copolymers in reaction product (a) are those of maleic anhydride and isopropylene, preferably of maleic anhydride and ethylene, and, most preferably, of maleic anhydride and styrene. In these copolymers, maleic anhydride on the one hand, and propylene, ethylene or styrene on the other, are preferably employed in equimolar amounts. To produce the product (a), these copolymers are reacted with N,N-disubstituted 1,2-ethylenediamine or, in particular, 1,3-propylenediamine, wherein the substituents together with the nitrogen atom form e.g. a pyrrolidine, piperidine or, preferably, morpholine ring, or wherein the substituents are n-propyl, preferably ethyl, or, most preferably, methyl.

In the homopolymer (b) and copolymer (c), 4-vinylpyridine is preferably not substituted. The homopolymer (b) is preferred to the copolymer (c). In the copolymer (c), the starting components are employed in a molar ratio of styrene to vinylpyridine of 1:1 to 1:10, preferably 1:3 to 1:6, and, most preferably, 1:5.

The reaction product (a), the homopolymer (b) and copolymer (c) are quaternised with either an alkenyl halide, or preferably an alkyl halide, which contains at least 6, preferably 6 to 12, carbon atoms, e.g. n-dodecyl chloride by itself, or with a halomethylnaphthalene, e.g. chloromethylnaphthalene, or a halomethyldiphenyl, e.g. chloromethyldiphenyl, a haloacetic acid or an alkali metal salt or alkyl ester thereof containing 1 to 12 carbon atoms in the alkyl moiety, e.g. chloroacetic acid, the sodium salt thereof or n-dodecyl ester thereof, preferably chloroacetamide or chloroacetonitrile, or with a benzyl halide which can be substituted by halogen, e.g. chlorine, or by ethyl or preferably methyl, or preferably with an unsubstituted benzyl halide, e.g. benzyl chloride, whilst the last mentioned quaternising agents are employed alone, in admixture with each other, e.g. a mixture of benzyl chloride and chloroacetamide, 1-chloromethylnaphthalene, chloroacetic acid n-dodecyl ester or sodium chloroacetate, or in admixture with an alkenyl halide or preferably with an alkyl halide containing a maximum of 4, preferably 1 or 2, carbon atoms, e.g. methyl chloride. Thus, for example, methyl chloride is never used alone, but always in admixture with e.g. benzyl chloride, whereas e.g. n-dodecyl chloride is always used by itself. The preferred quaternising agent is benzyl chloride, especially by itself, but also in admixture with sodium chloroacetate.

The homopolymer (d) is quaternised in particular with a tertiary monoamine or a mixture of amines, two substituents of which together with the nitrogen atom form a pyrrolidine or piperidine ring, preferably a pyridine or morpholine ring, or two substituents of which are preferably ethyl and especially methyl, whilst the third substituent is alkenyl, preferably alkyl, and especially aryl which is unsubstituted or substituted by alkyl or alkylene of 1 to 4, preferably 1 or 2, carbon atoms, and which contains a total of at most 18, preferably 2 to 18, most preferably 4 to 12, carbon atoms. Examples of preferred tertiary monoamines of this kind are N,N-dimethyl- or N,N-diethylnaphthylamine, N,N-dimethyl- or N,N-diethylbenzylamine, N,N-dimethyl- or N,N-diethylaniline, and N-methyl- or N-ethylpyridine, N-methyl- or N-ethylpiperidine or N-methyl- or N-ethylmorpholine. Dimethylbenzylamine is especially preferred.

As especially preferred quaternary ammonium salts, the assistants of the present invention contain (a) a reaction product of a copolymer of maleic anhydride and ethylene, preferably of maleic anhydride and styrene, with N,N-diethyl- or N,N-dimethylethylenediamine, with N-(3-amino-n-propyl)-morpholine or preferably with N,N-diethyl-n-propylenediamine, most preferably N,N-dimethyl-n-propylenediamine, or a homopolymer (b) of unsubstituted 4-vinylpyridine. The reaction product (a) is quaternised preferably with n-dodecyl chloride, 1-chloromethyl-2-methylbenzene, 1-chloromethylnaphthalene, mixtures of benzyl chloride and 1-chloromethylnaphthalene, chloroacetamide, sodium chloroacetate or methyl chloride, or especially with benzyl chloride, and the homopolymer (b), as specific example of a quaternary ammonium salt, is quaternised with benzyl chloride. A further specific example of a preferred quaternary ammonium salt is the reaction product, quaternised with benzyl chloride, of a copolymer of maleic anhydride and styrene with N,N-dimethyl-n-propylenediamine.

The exact chemical constitution of the quaternary ammonium salts in the assistants of this invention is not known. It is to be assumed, however, that these salts contain recurring units of one of the probable formulae

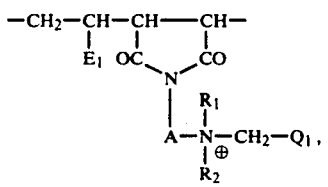

(1)

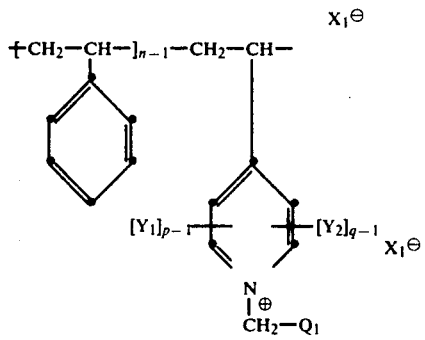

(2)

or

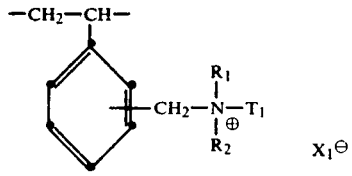

(3)

wherein $Q_1$ is alkyl or alkenyl containing at least 6, preferably 6 to 12, carbon atoms, or is a substituent of one of the formulae

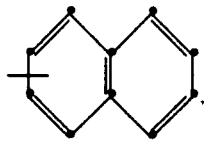

(4)

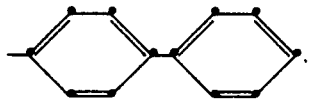

(5)

$-CO-NH_2$, (6)

$-C\equiv N$ (7)

-continued

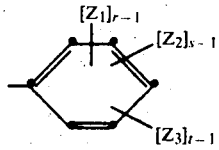

(8)

or (9) $-CH_2-COOM_1$, or a mixture of at least one substituent of one of the formulae (4) to (9) and alkyl or alkenyl containing a maximum of 4 carbon atoms, A is ethylene or n-propylene, $E_1$ is hydrogen, methyl or phenyl, $M_1$ is hydrogen or an alkali metal, e.g. potassium or sodium, or alkyl of 1 to 12 carbon atoms, each of $R_1$ and $R_2$ is alkyl of 1 to 4 carbon atoms or together with the nitrogen atom to which they are attached form a 5- or 6-membered ring which optionally contains an oxygen atom as second heteroatom, $T_1$ is alkyl, alkenyl, or aryl which contains a maximum of 18 carbon atoms and is unsubstituted or substituted by alkyl or alkylene, $X_1\ominus$ is halogen, each of $Y_1$ and $Y_2$ is methyl or ethyl, and each of $Z_1$, $Z_2$ and $Z_3$ is halogen, ethyl or preferably methyl, and each of n, p, r, s and t is 1 or 2.

Preferred quaternary ammonium salts contain recurring units of the formula

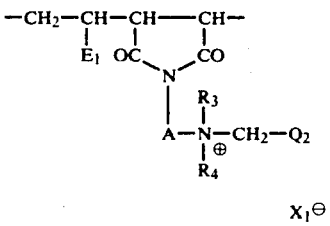

(10)

wherein each of $R_3$ and $R_4$ is methyl, ethyl, n-propyl or n-butyl, or together with the nitrogen atom to which they are attached form a pyrrolidine, piperidine or morpholine radical, $Q_2$ is a substituent of one of the indicated formulae (4) to (8) or is a mixture of at least one of the formulae (4) to (8) with alkyl or alkenyl containing a maximum of 4 carbon atoms, preferably with ethyl or methyl, and A, $E_1$ and $X_1\ominus$ have the given meanings; or especially recurring units of the formula

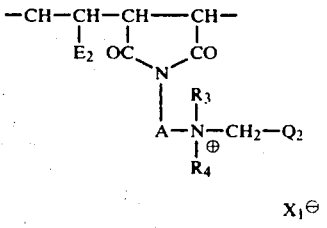

(11)

wherein $E_2$ is hydrogen or phenyl, and A, $R_3$, $R_4$, $Q_2$ and $X_1\ominus$ have the given meanings; or preferably recurring units of the formula

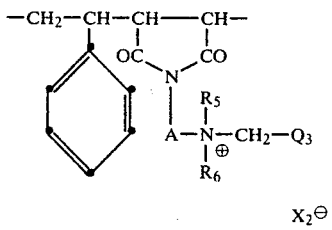

(12)

wherein $Q_2$ is —CN, —CO—$NH_2$ or phenyl, A is ethylene or n-propylene; $X_2\ominus$ is chlorine or bromine and each of $R_5$ and $R_6$ is methyl, ethyl or n-propyl, or $R_5$ and $R_6$ together with the nitrogen atom to which they are attached form a morpholine radical. Preferred quaternary ammonium salts contain recurring units of the formula

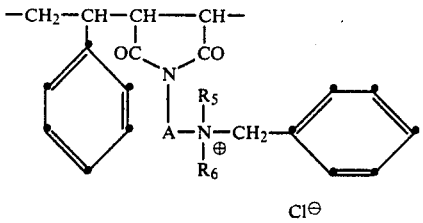

(13)

wherein A is ethylene or n-propylene and each of $R_5$ and $R_6$ is methyl or ethyl.

Other preferred quaternary ammonium salts contain recurring units of the formula

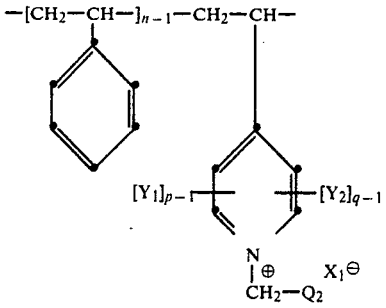

(14)

wherein $Q_2$, $X_1\ominus$, $Y_1$, $Y_2$, n, p and q have the given meanings; or especially recurring units of the formula

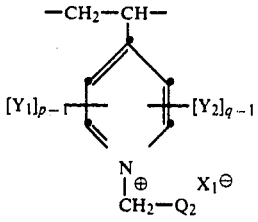

(15)

wherein $Q_2$, $X_1\ominus$, $Y_1$, $Y_2$, p and q have the given meanings; or most especially recurring units of the formula

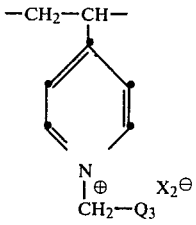

(16)

wherein $X_2\ominus$ and $Q_3$ have the given meanings.

Further preferred quaternary ammonium salts contain recurring units of the formula

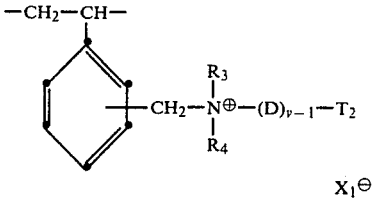

(17)

wherein D is ethylene or ethylene, $T_2$ is alkyl or aryl containing a maximum of 18 carbon atoms which is unsubstituted or substituted by methyl or ethyl, and v is 1 or 2, and $R_3$, $R_4$ and $X_1\ominus$ have the given meanings; or preferably recurring units of one of the formulae

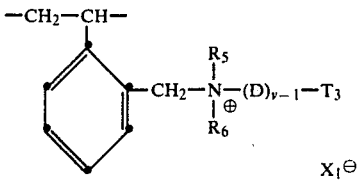

(18)

or

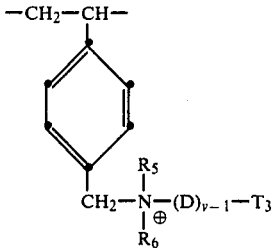

(19)

wherein $T_3$ is alkyl of 1 to 12 carbon atoms, or benzyl, phenyl or naphthyl which is unsubstituted or substituted by ethyl or preferably methyl, and D, $R_5$, $R_6$, $X_1\ominus$ and v have the given meanings; or especially recurring units of one of the formulae

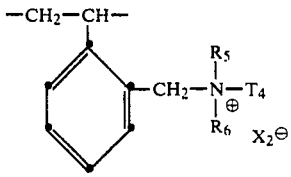

(20)

or

-continued
(21)
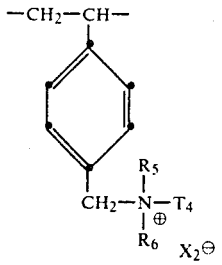
wherein $T_4$ is naphthyl, benzyl or phenyl, each of $R_5$ and $R_6$ is ethyl or methyl, and $X_2\ominus$ is bromine or chlorine.
Further especially preferred assistants of the present invention contain, as examples of individual specific ammonium salts, those which contain the recurring units of the following formulae:
(22)
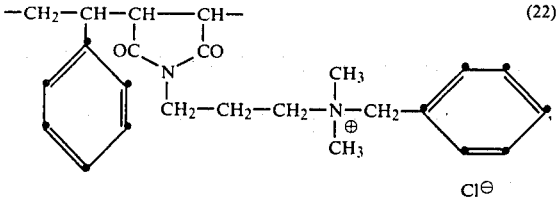
(23)
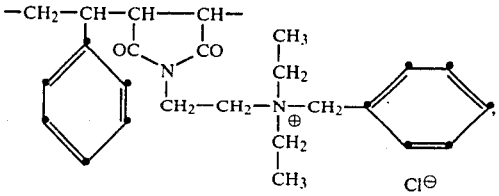
(24)
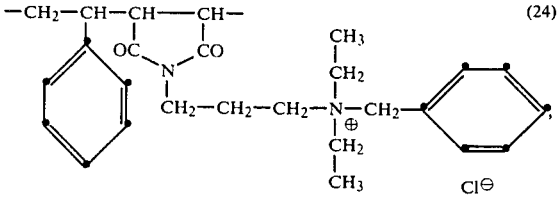
(25)
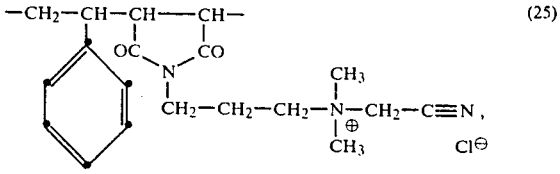
(26)
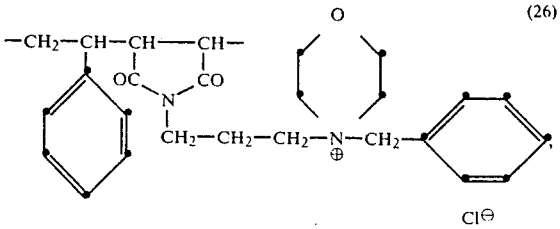
(27)
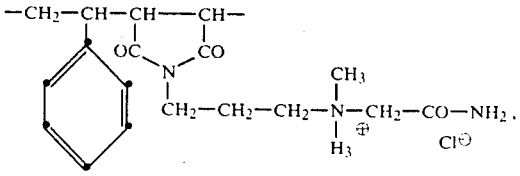
-continued
(28)
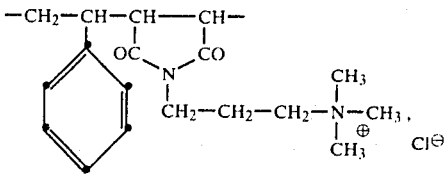
(29)
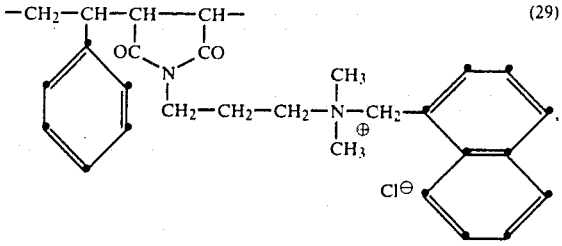
(30)
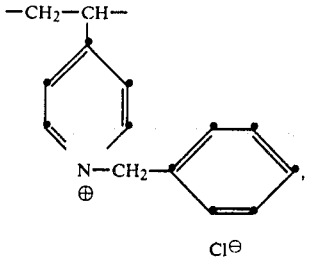
(31)
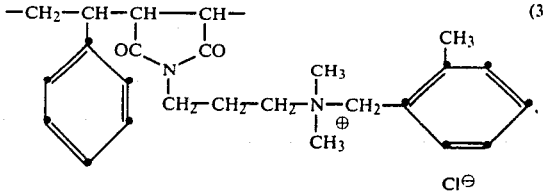
(32)
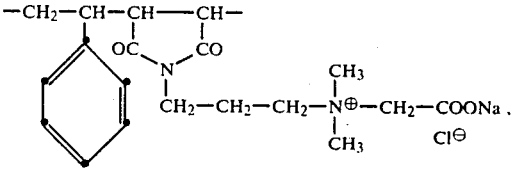
(33)
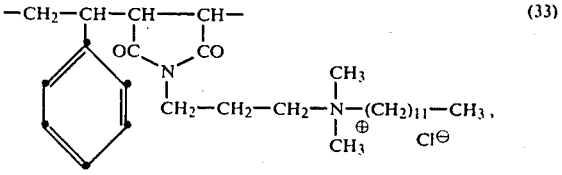
(34)
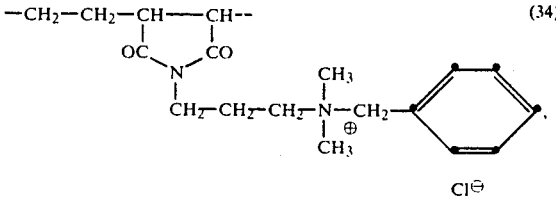
(35)
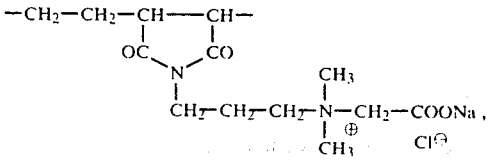

-continued (36)

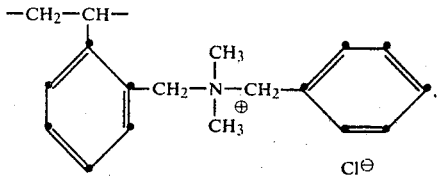

(37)

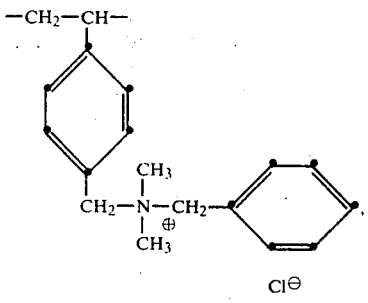

(38)

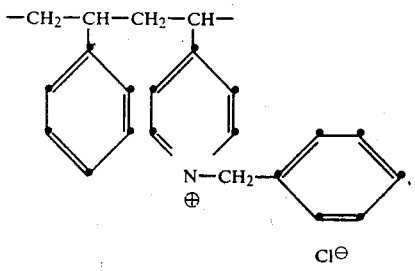

(39)

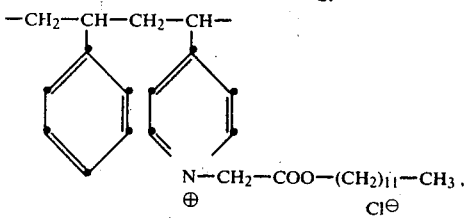

(40)

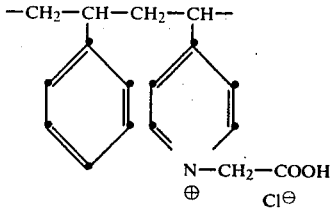

(41)

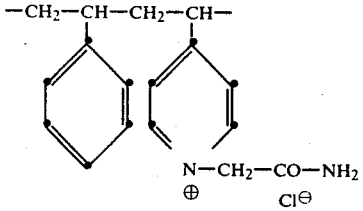

The quaternary ammonium salts containing recurring units of the formula (30) and especially of the formula (22) are preferred.

The molecular weight of the quaternary ammonium salts in the assistants of the present invention which contain recurring units of the formulae (1), (2) or (3), is usually 1500 to 1,000,000. Accordingly, the quaternary ammonium salts usually contain 4 to 3000, preferably 8 to 3000, recurring units of the formulae (1), (2) or (3), and especially 1800 to 2200 recurring units of the formula (30), or 7 to 36 recurring units of one of the formulae (22) to (29) or (31) to (35).

These quaternary ammonium salts are known per se and are described e.g. in German Offenlegungsschrift No. 2 604 910, British Pat. No. 855 028, J. Macromol. Sci. Chem. A4(6), pp. 1327-1417 (October 1970), J. Polymer Science Vol. IV, pp. 97-133 (1949), and Vol. XXV, pp. 201-215 (1957). In particular, German Offenlegungsschrift No. 2 609 910 and British Pat. No. 855 028, and pages 1327-1417 of J. Macromol. Sci. Chem. A4(6), disclose quaternary ammonium salts containing units corresponding at least partially to the units of formulae (1) and (2), wherein n is 1, whereas quaternary ammonium salts corresponding at least partially to the units of formula (2), wherein n is 2, or of formula (3), are disclosed in J. Polymer Science, Vol. IV, pages 97-133, and Vol. XXV, pages 101-215.

The quaternary ammonium salts which contain recurring units of the formula (1) are usually obtained by copolymerising the unsaturated compound of the formula

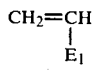

(42)

wherein E has the given meaning, with maleic anhydride, preferably in equimolar amounts at elevated temperature, e.g. 70° to 100° C., in the presence of an inert solvent, preferably an aromatic hydrocarbon such as toluene or a mixture of xylenes, and of a catalyst such as an azo compound or a peroxide, then reacting the copolymer, preferably without isolating it, as a rule with an equimolar amount of a diamine of the formula

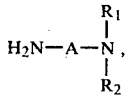

(43)

wherein A, $R_1$ and $R_2$ have the given meanings, at elevated temperature, e.g. 110° to 140° C., and preferably isolating the reaction product, and finally, quaternising the reaction product with an equimolar amount of a quaternising agent of the formula

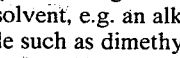

(44)

wherein $X_1$ and $Q_1$ have the given meanings, preferably in an inert polar solvent, e.g. an alkanol such as isopropanol, or an amide such as dimethyl formamide, at elevated temperature, e.g. 60° to 100° C.

The quaternary ammonium salts which contain recurring units of the probable formula (2), wherein n is 1, are usually obtained by homopolymerising the unsaturated compound of the formula

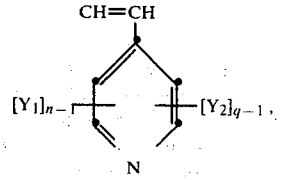

(45)

wherein $Y_1$, $Y_2$, p and q have the given meanings, preferably in water in the presence of a dispersing agent and of a catalyst of the type described above, at elevated temperature, e.g. 40° to 60° C., purifying the homopolymer preferably by reprecipitation in a water-soluble solvent, e.g. an alkanol such as ethanol, and subsequently, as described above, quaternising the product with a quaternising agent of the formula (44).

If n in formula (2) is 2, the procedure is analogous, except that, as starting material in addition to the compound of the formula (45), styrene is used as comonomer, the molar ratio of styrene to compound of the formula (45) being 1:1 to 1:10.

The quaternary ammonium salts which contain recurring units of the formula (3) are usually obtained by homopolymerising the unsaturated compound of the formula .

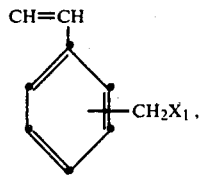

(46)

wherein $X_1$ is halogen, and quaternising the homopolymer as a rule with an equimolar amount of a tertiary amine of the formula

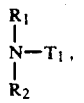

(47)

wherein $R_1$, $R_2$ and $T_1$ have the given meanings, preferably in an inert polar solvent, e.g. a free or etherified alkanol such as isopropanol or 1-methoxy-2-ethanol, or an amide such as dimethyl formamide, at elevated temperature, e.g. 60° to 90° C.

As they contain quaternised compounds, the assistants are as a rule water-soluble are preferably employed in the form of dilute aqueous solutions in the process of the invention. However, they can also contain the dispersants employed in dyeing and printing, or organic solvents.

It is advantageous to employ, as assistant in the process of the invention, 0.01 to 5%, preferably 0.05 to 2%, most preferably 0.1 to 1%, of the quaternary ammonium salts which contain recurring units of the formula (1), (2) or (3), calculated as pure ammonium salt, based on the weight of the fibrous material to be dyed or printed. Suitable organic fibrous material which can be dyed or printed by the process of the invention comprises in particular manmade and natural textile fibres, i.e. natural or especially man-made fibres by themselves or blends of man-made and natural fibres. Blends of different man-made fibres are also suitable. These textile materials are in widely different stages of processing, e.g. tow, slubbing, filaments, yarns, muffs, wovens, knits, nonwoven articles, or finished garments.

Suitable textile materials made of natural fibres include those made of cellulosic material, especially of cotton, and of wool and silk, whilst textiles made of made-made fibres are e.g. those made of high molecular polyesters, such as polyethylene terephthalate or polycyclohexanedimethylene terephthalate, of polyamides, such as polyhexamethylenediamine adipate, poly-ε-caprolactam or poly-ω-aminoundecanoic acid, of polyolefins, polyacrylonitriles or acrylonitrile copolymers, and of polyurethanes, polyvinyl chlorides, polyvinyl acetates, and of cellulose 21/2 acetate and cellulose triacetate.

Polyacrylonitrile fibres or modified polyester or polyamide fibres which can be dyed with cationic dyes are especially suitable for dyeing or printing by the process of the invention. The rapid-dyeing fibres are especially preferred. Modified polyester and polyamide fibres are described e.g. in Teintures et Apprêts 144, pp. 163-167 (1967). Rapid-dyeing polyacrylonitrile fibres are preferred and are described e.g. in Melliand Textilberichte 12, 1968, pp. 1436-1443, in J. Soc. Dyers and Colourists, May 1971, pp. 149-155, and Febr. 1978, pp. 49-52, in Teintex 5, 1973, pp. 281-296, in Chemiefasern-/Textilind., May 1978, pp. 391-396, and Jan. 1974, pp. 52-60.

By polyacrylonitrile fabrics are also meant in this context modacrylic fibres for the production of which, in addition to acrylonitrile, other vinyl compounds have been used, e.g. vinyl chloride, vinyl acetate, vinylidene chloride, vinylidene cyanide and alkyl acrylates, provided the amount of these other vinyl compounds is not greater than 20%, based on the weight of the materials.

The dyeing preparations are in the form of aqueous and/or organic solutions or dispersions, or of printing pastes or inks, which, in addition to containing a dye, contain further ingredients, e.g. acids, salts, urea and other assistants, such as oxalkylation products of fatty amines, fatty alcohols, alkylphenols, fatty acids and fatty acid amides.

Especially for dyeing polyacrylonitrile fibres, the preparations contain cationic dyes. These dyes belong to a very wide variety of groups. Examples of suitable dyes are di- and triphenylmethane dyes, rhodamine dyes and azo and anthraquinone dyes which contain onium groups, and also thiazine, oxazine, methine and azomethine dyes. The cationic dyes are described e.g. in the Colour Index, 3rd Edition (1971), Vol. 1, under the heading "Basic Dyes". For dyeing and printing cellulosic fibre blends it is, however, also possible to use e.g. direct dyes in a further embodiment of the process of the invention. These dyes likewise belong to a very wide variety of groups and are also described e.g. in the Colour Index, Vol. 2, under the heading "Direct Dyes".

In the process of the invention, the fibrous material is treated with the assistant before, during or after dyeing or printing. Preferably, however, the fibrous material is dyed in the presence of the assistant, which is used in particular as retarder and levelling agent for the cationic dyes, and the material is treated with a preparation which contains the dye and the assistant together by the "all-in" process. Accordingly, the invention also relates to the aqueous preparation for carrying out the dyeing process of the invention, said preparation containing a cationic dye and the assistant.

In a further embodiment of the process of the invention, the already dyed or treated fibrous material is given an aftertreatment with the assistant to obtain an enhancement of the wetfastness properties of the dyeing or print. Accordingly, the assistant is also employed as an agent for enhancing wetfastness properties. This utility is especially suitable for aftertreating cellulosic fibrous material which has been dyed or printed with direct dyes.

In the preferred embodiment of the process of this invention, polyacrylonitrile textiles are dyed in conventional manner e.g. by the exhaust method, wherein the goods are put into an aqueous liquor, which has been heated to about 50°-60° C. and which, especially in the all-in process, contains a cationic dye, the assistant, salts, such as sodium acetate and sodium sulfate, and acids, such as acetic acid or formic acid, then the temperature of the bath is raised in the course of about 30 minutes to approximately 100° C., and the dyebath is subsequently kept at this temperature until it is exhausted. It is also possible, however, to add the basic dye to the dyebath at a later stage, e.g. when the temperature of the bath has risen to about 60° C. Further, it is also possible to provide the goods with a pretreatment at a temperature of 40° to 100° C. with a liquor which contains the usual salts and acids and the assistant of the invention, but which still contains no dye, then to add the dye and to carry out dyeing at 100° C.

The assistant can also be used in commercially available reserve printing pastes. In this case, the fibrous material is given a pretreatment, preferably patchwise, with a printing paste which contains no dye and the printing assistant as a reserving agent, and dyeing is subsequently carried out e.g. by the exhaust method. In this embodiment of the process of the invention, in which the printing assistant is employed as a reserving agent, it is possible to obtain advantageous multi-shade effects.

An especially advantageous shading effect can be obtained by using the assistant in the course of the dyeing procedure, e.g. between the addition of different dyes. The dyeings obtained with the assistants, especially on polyacrylonitrile fibres, are distinguished by very good levelness without any substantial loss of dye yield on the fibres. It is also possible to enhance the wetfastness properties of the dyeings or prints on cellulosic fibre blends with the assistant. Finally, the use of the assistant with more than one class of dye and corresponding types of fibre, i.e. fibre blends, and the good campatibility of the assistant with most conventional non-ionic and cationic textile assistants, e.g. also textile finishing agents, constitute further advantages of the present invention.

In the following Manufacturing Directions and Examples, parts and percentages are by weight.

MANUFACTURING DIRECTIONS

A. Manufacture of homopolymers and copolymers

Copolymer A 1

261 parts of a monomer solution are prepared from 52 parts (0.5 mole) of styrene and 49 parts (0.5 mole) of maleic anhydride in 160 parts of a xylene mixture, and 20 parts of a catalyst solution are prepared from 1 part of azo-bis (isobutyric nitrile) in 15 parts of a xylene mixture and 4 parts of dimethyl formamide. 87 parts of the monomer solution are then heated to 70° C. in an inert nitrogen atmosphere. At this temperature 5 parts of the catalyst solution are added to the 87 parts of the monomer solution. The remaining 174 parts of the monomer solution and the remaining 15 parts of the catalyst solution are added separately and simultaneously in the course of 1 hour, whereupon the reaction mixture becomes turbid. The resultant suspension is then kept for 2 hours at 70° C. and for a further hour at 80° C.

The specific viscosity of a 1% solution of the copolymer in dimethyl formamide at 20° C. is 0.35, corresponding to an average molecular weight of 3400.

Copolymers A 2 to A 6

Copolymers A 2 to A 6 are obtained in accordance with Table I by procedures analogous to that employed for obtaining copolymer A 1:

TABLE I

| Copolymer | Temperature °C. | Monomer solution | Catalyst solution | Reaction course | Viscosity of the 1% solution in DMF at 20° C. | Average molecular weight |
|---|---|---|---|---|---|---|
| A 1 | 70 | $X_1$ | $Y_1$ | $Z_1$ | 0.35 | 3400 |
| A 2 | 80 | $X_2$ | $Y_2$ | $Z_2$ | 0.70 | 5400 |
| A 3 | 70 | $X_3$ | $Y_3$ | $Z_3$ | 0.91 | 7200 |
| A 4 | 80 | $X_4$ | $Y_1$ | $Z_4$ | 0.28 | 2600 |
| A 5 | 100 | $X_4$ | $Y_1$ | $Z_5$ | 0.18 | 1600 |
| A 6 | 80 | $X_5$ | $Y_4$ | $Z_6$ | 0.60 | 4600 |

$X_1$ 52 parts of styrene, 49 parts of maleic anhydride and 160 parts of xylene mixture $X_2$ 52 parts of styrene, 49 parts of maleic anhydride and 160 parts of toluene $X_3$ 52 parts of styrene, 49 parts of maleic anhydride and 100 parts of toluene $X_4$ 52 parts of styrene, 49 parts of maleic anhydride and 200 parts of xylene mixture $X_5$ 52 parts of styrene, 49 parts of maleic anhydride and 200 parts of xylene mixture $Y_1$ 1 part of azo-bis(isobutyric nitrile), 15 parts of xylene mixture and 4 parts of dimethyl formamide $Y_2$ 1 part of azo-bis(isobutyric nitrile), 15 parts of xylene mixture and 4 parts of dimethyl formamide $Y_3$ 1 part of benzoyl peroxide and 25 parts of toluene $Y_4$ 1 part of lauroyl peroxide and 25 parts of xylene mixture $Z_1$ to $\frac{1}{3}$ of $X_1$ add $\frac{1}{4}$ of $Y_1$, then $\frac{2}{3}$ of $X_1$ and $\frac{3}{4}$ of $Y_1$ separately in the course of 1 hour $Z_2$ to 1/5 of $X_2$ and 1/5 of $Y_2$ add separately in the course of 90 minutes 4/5 of $X_2$ and $Y_2$ $Z_3$ to 100 parts of toluene and 1/5 of $X_3$ add 1/5 of $Y_3$, then 4/5 of $X_3$ and 4/5 of $Y_3$ separately in the course of $1\frac{1}{2}$ hours $Z_4$ to 50 parts of xylene mixture add $X_4$ and $Y_1$ separately in the course of 1 hour $Z_5$ to 50 parts of xylene mixture add $X_4$ and $Y_1$ separately in the course of 2 hours $Z_6$ to 100 parts of xylene mixture and $\frac{1}{2}$ of $X_5$ add $\frac{1}{2}$ of $Y_4$, then $\frac{1}{2}$ of $X_5$ and $\frac{1}{2}$ of $Y_4$ separately in the course of $1\frac{1}{4}$ hours.

HOMOPOLYMER A 7

105 parts (1 mole) of 4-vinylpyridine, 1 part of potassium persulfate and 0.52 part of the sodium salt of di(n-butyl) naphthalenesulfonic acid as dispersant, which has been dissolved beforehand in 150 parts of water, are heated in the course of 30 minutes to 50° C., whereupon a solid polymer mass gradually forms from the reaction mixture, which was originally a homogeneous emulsion. The reaction mixture is then allowed to stand for 4 hours at 50° C. The polymer mass is then collected by filtration, washed with 750 parts of water and dried under reduced pressure at 25° C. The dry, crude polymer is dissolved in 1100 parts of ethanol. The solution is added to 11000 parts of water in the course of 30 minutes, whereupon a resinous polymer is obtained. The reprecipitated polymer is collected by filtration and dried under reduced pressure at 25° C.

Yield: 53.5 parts of dry, reprecipitated, yellowish homopolymer (51% of theory) with an average molecular weight of 230,000 (calculated by light scattering).

COPOLYMER A 8

Commercially available copolymer of ethylene and maleic anhydride in the molar ratio 1:1. Specific viscosity as 1% solution in dimethyl formamide at 25° C.: 0.1 (corresponding to an average molecular weight of 1000).

HOMOPOLYMER A 9

Commercially available homopolymer of 2-vinyl- and 4-vinylbenzyl chloride. The ratio of the isomers in 2- and 4-position is 6:4. The chlorine content of the homopolymer is 23.2%. The molecular weight cannot be calculated with sufficient accuracy either by viscosity or light scattering, and is probably between 1000 and 500,000.

COPOLYMER A 10

Commercially available copolymer of styrene and 4-vinylpyridine in the molar ratio 1:5 and having a nitrogen content of 11.02%. The molecular weight cannot be calculated with sufficient accuracy either by viscosity measurements or by light scattering and is probably between 500 and 350,000.

B. REACTION OF COPOLYMERS WITH A DIAMINE

Reaction product B 1

A suspension of copolymer A 1 (obtained from maleic anhydride and styrene) is diluted with 295 parts of a xylene mixture and heated to 130° C. At this temperature 53 parts of 3-dimethylamino-1-propylamine (0.517 mole) are added to the suspension in the course of 1 hour. The reaction mixture is then heated to a reflux temperature of about 140° C., and the water formed during the reaction is distilled off as an azeotrope. About 9 parts (0.5 mole) of water are obtained. The reaction mixture, now in the form of a clear solution, is cooled to 70° C. and concentrated by distilling the xylene mixture at this temperature under reduced pressure. A viscous, concentrated solution of the reaction product in xylene is obtained in virtually quantitative yield.

REACTION PRODUCTS B 2 TO B 10

The reaction products B 2 to B 10 listed in Table II are obtained by procedures analogous to that employed for obtaining reaction product B 1, using in each case 0.5 mole of the corresponding copolymer.

TABLE II

| Reaction product | Copolymer | Solvent | Temperature °C. | Diamine type | Diamine parts | Diamine moles |
|---|---|---|---|---|---|---|
| B 1 | A 1 | xylene mixture | 140 | 3-dimethylamino-1-propylamine | 53 | 0.517 |
| B 2 | A 3 | toluene | 111 | 3-dimethylamino-1-propylamine | 53 | 0.517 |
| B 3 | A 4 | xylene mixture | 140 | 3-dimethylamino-1-propylamine | 53 | 0.517 |
| B 4 | A 2 | xylene mixture | 140 | 2-diethylamino-1-ethylamine | 60.2 | 0.577 |
| B 5 | A 2 | xylene mixture | 140 | 3-diethylamino-1-propylamine | 67.6 | 0.519 |
| B 6 | A 5 | xylene mixture | 140 | 3-dimethylamino-1-propylamine | 53 | 0.517 |
| B 7 | A 2 | xylene mixture | 140 | 3-dimethylamino-1-propylamine | 53 | 0.517 |
| B 8 | A 2 | xylene mixture | 140 | N-(3-amino-n-propyl)-morpholine | 72 | 0.500 |
| B 9 | A 6 | xylene mixture | 140 | 3-dimethylamino-1-propylamine | 53 | 0.517 |
| B 10 | A 8 | xylene mixture[a] | 130 | 3-dimethylamino-1-propylamine | 53 | 0.517 |

[a]562 parts of xylene mixture

C. QUATERNISATION OF REACTION PRODUCTS AND HOMOPOLYMERS AND COPOLYMERS

Quaternisation product C 1

Reaction product B 1 is dissolved in 300 parts of isopropanol. To this solution are added 63 parts (0.5 mole) of benzyl chloride. The reaction solution is heated to a reflux temperature of about 80° C. and kept at this temperature until a sample of the reaction solution is soluble in water and has a pH value of less than 7 (as a rule 4 hours). The solvent (isopropanol and xylene mixture) is removed from the reaction solution under reduced pressure with the addition of water, affording a 10 to 30% aqueous solution of the quaternised copolymer which contains on average 17 recurring units of the formula (12) and which is suitable for further use.

QUATERNISATION PRODUCTS C 2 TO C 18

The quaternisation products C 2 to C 18 of Table III are obtained by procedures analogous to the one employed for obtaining C 1:

TABLE III

| Quaternisation product | Reaction product | Quaternising agent type | Quaternising agent parts | Quaternising agent moles | Quaternisation product obtained formula | Quaternisation product obtained n (b) |
|---|---|---|---|---|---|---|
| C 1 | B 1 | benzyl chloride | 63 | 0.5 | (22) | 17 |
| C 2 | B 2 | benzyl chloride | 63 | 0.5 | (22) | 35 |
| C 3 | B 3 | benzyl chloride | 63 | 0.5 | (22) | 13 |
| C 4 | B 4 | benzyl chloride | 63 | 0.5 | (23) | 27 |
| C 5 | B 5 | benzyl chloride | 63 | 0.5 | (24) | 27 |
| C 6 | B 6 | benzyl chloride | 63 | 0.5 | (22) | 8 |
| C 7 | B 7 | chloro-aceto-nitrile | 38 | 0.5 | (25) | 27 |
| C 8 | B 8 | benzyl chloride | 63 | 0.5 | (26) | 27 |
| C 9 | B 9 | benzyl chloride | 63 | 0.5 | (22) | 24 |
| C 10 | B 9 | benzyl chloride | 31.5 | 0.25 | 50% (22) 50% (27) | 24 |
| | | chloro-acetamide | 23.2 | 0.25 | | |
| C 11 | B 9 | benzyl chloride | 41.6 | 0.66 | 66.6% (22) 33.3% (28) | 24 |
| | | methyl chloride | (c) | (c) | | |
| C 12 | B 9 | benzyl chloride | 20.8 | 0.33 | 33.3% (22) 66.6% (29) | 27 |
| | | 1-chloro- | 58.3 | 0.66 | | |

TABLE III-continued

| Quaternisation product | Reaction product | Quaternising agent type | parts | moles | Quaternisation product obtained formula | n (b) |
|---|---|---|---|---|---|---|
| | | methylnaphthaline | | | | |
| C 13 | A 7 (d) | benzyl chloride (e) | 15.2 | 0.12 | (30) | 2200 (f) |
| C 14 | B 6 | 1-chloromethyl-2-methylbenzene | 70.3 | 0.5 | (31) | 8 |
| C 15 | B 1 | benzyl chloride | 56.7 | 0.45 | 90% (22) 10% (32) | 17 |
| | | sodium chloroacetate | 5.8 | 0.05 | | |
| C 16 | B 1 | n-dodecyl chloride | 102.4 | 0.5 | (33) | 17 |
| C 17 | B 10 | benzyl chloride | 50.7 | 0.45 | 90% (34) 10% (35) | 8 |
| | | sodium chloroacetate | 5.8 | 0.05 | | |
| C 18 | B 6 | 1-chloromethylnaphthaline | 88.3 | 0.5 | (29) | 8 |

(b) n indicates the average number of recurring units of the formulae (12) to (35)
(c) an excess of gaseous methyl chloride is introduced
(d) homopolymer, batch: 10.5 parts (0.1 mole)
(e) homopolymer dissolved in 200 parts of dimethyl formamide, reaction temperature 90° to 95° C.
(f) calculated on the content of ionogenic chlorine

QUATERNISATION PRODUCT C 19

15.26 parts of homopolymer A 9, 100 parts of 1-methoxy-2-ethanol, 50 parts of dimethyl formamide and 15 parts of benzyl dimethylamine (1.11 mole/mole of vinylbenzyl chloride employed) are heated to 80° C. and the mixture is kept at this temperature for 24 hours. Then the reaction mixture is concentrated to dryness at 80° C. under reduced pressure, affording 27 parts of a quaternisation product in the form of a dark brown powder which dissolves in water to form a clear solution. The product contains 8 to 3000 recurring units of the formulae (36) and (37), corresponding to 60% of units of the formula (36) and 40% of units of the formula (37). The degree of quaternisation is calculated by determining the nitrogen content and the content of ionogenically bound chlorine. With respect to quaternisation product C 19 it is 19.99%.

QUATERNISATION PRODUCT C 20

38 parts of benzyl chloride (1.50 moles/mole of vinylpyridine employed) are added at 60° C. to a solution of 25 parts of copolymer A 10 in 300 parts of dimethyl formamide. The reaction mixture is heated to 80° C. and kept for 24 hours at this temperature. During this time the reaction product falls out of the reaction mixture in the form of an amorphous precipitate. The reaction mixture is then cooled to 50° C. and 150 parts of methanol are added. The homogeneous reaction mixture is then concentrated to dryness under reduced pressure, affording 47.3 parts of a quaternisation product in the form of a dark brown powder which dissolves in water to form a clear solution. The product contains 8 to 3000 recurring units of the formula (38) and has a degree of quaternisation of 98%.

QUATERNISATION PRODUCT C 21

The procedures as indicated for obtaining product C 21 is repeated, except that a mixture of 100 parts of dimethyl formamide and 200 parts of 1-methoxy-2-ethanol is used instead of 300 parts of dimethyl formamide, affording 54.9 parts of a quaternisation product in the form of a dark brown powder which dissolves in water to form a clear solution. The product contains 8 to 3000 recurring units of the formula (38) and has a degree of quaternisation of 100%.

QUATERNISATION PRODUCT C 22

12.7 parts of copolymer A 10 are dissolved at 60° C. in 250 parts of methyl cellosolve. This solution is cooled to 20° C. and then, at this temperature, 1.3 parts of chloroacetic acid n-dodecyl ester (0.05 mole/mole of vinylpyridine employed) are added. The reaction mixture is heated to 80° C. and kept at this temperature for 25 hours. After this time the reaction mixture is cooled again to 20° C. and, at this temperature, 14.1 parts of benzyl chloride (1.11 moles/mole of vinylpyridine employed) are added. After this addition, the reaction mixture is heated once more to 80° C. and kept at this temperature for 12 hours. The reaction mixture is then evaporated to dryness at 80° C. under reduced pressure, affording 28 parts of a quaternisation product in the form of a brown water-soluble powder. The product has a degree of quaternisation of 86% and contains 8 to 3000 units of the formulae (38) and (39), corresponding to 95% of units of the formula (38) and 5% units of the formula (39).

QUATERNISATION PRODUCTS C 23 to C 27

Each of the quaternisation products C 23 to C 27 is obtained by a procedure analogous to the one employed for obtaining product C 22 from 12.7 parts of copolymer A 10 with the respective amount of quaternising agent indicated in Table IV:

TABLE IV

| Quaternisation product | Quaternising agent | Quaternisation product obtained (brown, water-soluble powder) parts | degree of quaternisation % | No. of units | units of formula |
|---|---|---|---|---|---|
| C 22 | 1.3 parts of chloroacetic acid n-dodecyl ester (0.05 mole/mole*) | 28.0 | 86 | 8 to 3000 | 95% (38) |
| | 14.1 parts of benzyl chloride (1.11 mole/mole*) | | | | 5% (39) |
| C 23 | 3.9 parts of chloroacetic acid n-dodecyl ester (0.15 mole/mole*) | 28.8 | 80 | 8 to 3000 | 85% (38) |
| | 12.4 parts of benzyl chloride (0.98 mole/mole*) | | | | 15% (39) |
| C 24 | 0.95 part of chloroacetic acid (0.10 mole/mole*) | 30.0 | 91 | 8 to 3000 | 90% (38) |
| | 11.4 parts of benzyl chloride (0.90 mole/mole*) | | | | 10% (40) |
| C 25 | 0.47 part of chloroacetic acid (0.05 mole/mole*) | 28.0 | 100 | 8 to 3000 | 95% (38) |
| | 12.0 parts of benzyl chloride (0.95 mole/mole*) | | | | 5% (40) |
| C 26 | 0.94 part of chloroacetamide (0.10 mole/mole*) | 28.2 | 91 | 8 to 3000 | 90% (38) |
| | 11.4 parts of benzyl chloride (0.90 mole/mole*) | | | | 10% (41) |

TABLE IV-continued

| Quaternisation product | Quaternising agent | Quaternisation product obtained (brown, water-soluble powder) parts | degree of quaternisation % | No. of units | units of formula |
|---|---|---|---|---|---|
| C 27 | 0.47 part of chloroacetamide (0.05 mole/mole*)<br>12.0 parts of benzyl chloride (0.95 mole/mole*) | 27.7 | 92 | 8 to 3000 | 95% (38)<br>5% (41) |

*mole/mole of vinylpyridine employed

EXAMPLE 1

5 g of a polyacrylonitrile fabric (ORLON 42, registered trademark of DuPont) having a weight per unit area of 138 g/m$^2$ are treated in a dyeing machine for 10 minutes at 98° C. by the exhaust method with 200 ml of an aqueous liquor which has been adjusted to pH 4.0 with 80% acetic acid and which contains 0.017 g of a 30% aqueous solution of quaternisation product C 2 (0.1% of pure substance, based on the weight of the fabric). The fabric is constantly agitated in the dyeing machine during this treatment. Then a mixture of 0.007 g of the yellow dye of the formula

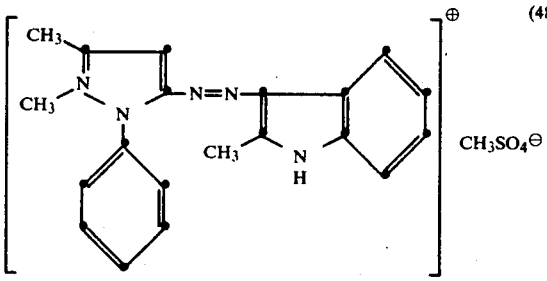

(48)

0.006 g of the red dye of the formula

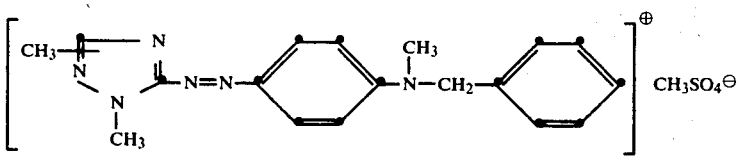

(49)

and 0.010 g of the blue dye of the formula

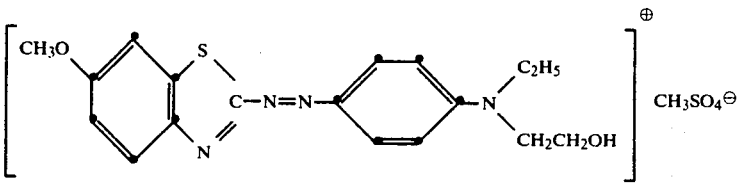

(50)

is added to the liquor at 98° C. The fabric is subsequently dyed for 60 minutes at 98° C. The liquor is then slowly cooled to 60° C. and the goods are rinsed and dried.

By adding quaternisation product C 2 as retarder in a pretreatment before dyeing, a slow, level build-up of shade is obtained on the fabric, so that the conventional cooling after preshrinking before addition of the dye is no longer necessary. The grey dyeing obtained is distinguished by outstanding levelness and good penetration of dye without detriment to the good wetfastness properties.

Similar results are obtained by using 0.1% of one of quaternisation products C 1 or C 3 to C 18 or 0.2% of one of quaternisation products C 19 to C 27.

EXAMPLE 2

1 g kg of a preshrunk, two-fold high bulk yarn (Tex 38×2) made of polyacrylonitrile (EUROACRYL, registered trademark of ANIC) in muff form is treated for 10 minutes at 70° C. by the exhaust method with 30 liters of an aqueous liquor which has been adjusted to pH 4.0 with 80% acetic acid and which contains 6.66 g of a 30% aqueous solution of quaternisation product C 15 (0.2% of pure substance, based on the weight of the yarn) and 2 g of the blue dye of formula (50). During this treatment, the liquor is constantly circulated through the muff. The bath temperature is then raised to 98° C. in the course of 30 minutes and the muff is dyed at this temperature for 60 minutes. The liquor is then slowly cooled to 60° C. and the muff is rinsed and dried.

The simultaneous use of quaternisation product C 15 as retarder together with the dye in the all-in process effects a light blue dyeing of the yarn which is distinguished by excellent levelness, good penetration of the dye, and good fastness properties.

Similar results are obtained with products C 1 to C 14 and C 16 to C 27.

EXAMPLE 3

10 g of the polyacrylonitrile fabric of Example 1 are printed patchwise with a printing paste of the following composition:

31 g of potato starch
39 g of locust bean gum
5 g of tararic acid
3.3 g of quaternisation product C 15 (as 30% aqueous solution, i.e. 10% of pure substance, based on the weight of the fabric), and
921.7 g of water.

The printed fabric is dried and then steamed for 24 minutes at 102° C. The fabric is then treated in a dyeing machine for 10 minutes at 70° C. by the exhaust method with 200 ml of a liquor which has been adjusted to pH 4.0 with 80% acetic acid and which contains 0.002 g of the blue dye of the formula

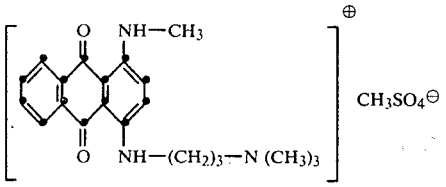

(51)

The fabric is constantly agitated in the liquor in the dyeing machine. The bath temperature is then raised to 98° C. in the course of 30 minutes and the fabric is dyed for 60 minutes at this temperature. The liquor is then slowly cooled to 60° C. and the fabric is rinsed and dried.

Pronounced two-shade effects are obtained on the fabric, the areas printed with quaternisation product C 15 being dyed light blue and the non-printed areas being dyed dark blue.

Similar results are obtained with quaternisation products C 1 to C 14 and C 16 to C 27.

EXAMPLE 4

In a dyeing machine, 100 g of a mercerised, bleached cotton fabric having a weight per unit area of 125 g/m$^2$ are put into 2 liters of an aqueous liquor of 50° C. which contains 3 g of the red dye of the formula

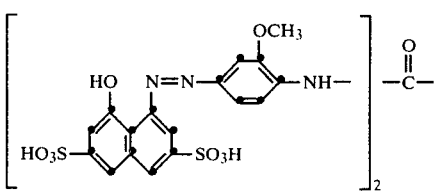

(52)

The temperature of the liquor is then raised to 98° C. in the course of 30 minutes and the fabric is dyed at this temperature while adding a total number of 20 g of calcined Glauber's salt. The fabric is constantly agitated in the liquor in the dyeing machine. The liquor is then slowly cooled to 40° C. and the fabric is rinsed and dried. The dyed fabric is then given an aftertreatment at 40° C. for 20 minutes by the exhaust method with 2 liters of an aqueous liquor which contains 13.3 g of quaternisation product C 17 in the form of a 30% aqueous solution (4% of pure substance, based on the weight of the fabric). The fabric is then wrung out and dried.

The red dyeing of the fabric given an aftertreatment with quaternisation product C 17 has excellent fastness when subjected to DIN Test No. 54006 [determination of colour fastness of dyeings and prints to water (severe)], whereas this fastness property of the dyeing is insufficient before the aftertreatment.

Similar results are obtained with quaternisation products C 1 to 16 and C 18 to C 27.

What is claimed is:

1. A process for dyeing or printing organic fibrous material using a dyeing or printing assistant which contains, as quaternary ammonium salt, (a) a reaction product of a copolymer of maleic anhydride and ethylene, propylene or styrene, with a N,N-disubstituted 1,2-ethylenediamine or 1,3-propylenediamine, in which the substituents are alkyl of 1 to 4 carbon atoms or together with the nitrogen atom form a 5- or 6-membered ring which optionally contains an oxygen atom as second heteroatom, (b) a homopolymer of a 4-vinylpyridine which is unsubstituted or substituted at a ring carbon atom by methyl or ethyl, (c) a copolymer of the above vinylpyridine and styrene, and the reaction product (a), the homopolymer (b) and the copolymer (c) are quaternised with an alkyl or alkenyl halide containing up to 6 carbon atoms alone, or with a halomethylnaphthalene, halomethyldiphenyl, chloroacetamide, chloroacetonitrile, or with a haloacetic acid or an alkali metal salt or alkyl ester of haloacetic acid containing 1 to 12 carbon atoms in the alkyl moiety, or with a benzyl halide which is unsubstituted or substituted by halogen, methyl or ethyl, alone or in admixture with each other or with an alkyl or alkenyl halide containing up to 4 carbon atoms, or (d) a homopolymer of a 2- or 4-vinylbenzyl chloride which is quaternised with a tertiary monoamine containing up to 20 carbon atoms, whilst two substituents of the monoamine are alkyl of 1 to 4 carbon atoms or together with the nitrogen atom form a 5- or 6-membered ring which optionally contains an oxygen atom as second heteroatom, and the third substituent of the monoamine is alkyl, alkenyl or aryl containing up to 18 carbon atoms which is unsubstituted or substituted by alkyl or alkylene.

2. A process according to claim 1, in which the assistant contains (a) a reaction product of a copolymer of maleic anhydride and ethylene, propylene or sytrene, with a N,N-disubstituted 1,2-ethylenediamine or 1,3-propylenediamine, in which the substituents are alkyl of 1 to 4 carbon atoms or together with the nitrogen atom form a 5- or 6-membered ring which optionally contains an oxygen atom as second heteroatom, or (b) a homopolymer of a 4-vinylpyridine which is unsubstituted or substituted at a ring carbon atom by methyl or ethyl, and the reaction product (a) and the homopolymer (b) are quaternised with a halomethylnaphthalene, halomethyldiphenyl, chloroacetamide, chloroacetonitrile or with a benzyl halide which is unsubstituted or substituted by halogen, methyl or ethyl, alone or in admixture with each other or with an alkyl or alkenyl halide containing up to 4 carbon atoms.

3. A process according to claim 1, in which the assistant contains a quaternary ammonium salt the recurring units of which correspond to the formulae

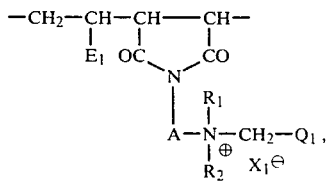

-continued

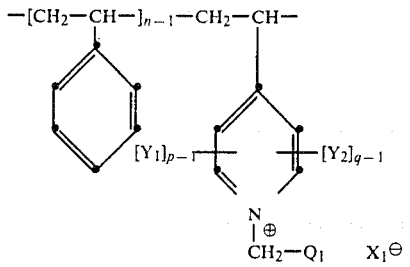

or

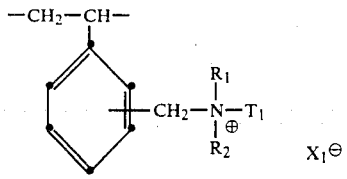

in which $Q_1$ is alkyl or alkenyl containing 6 to 12 carbon atoms, or is a substituent of the formulae

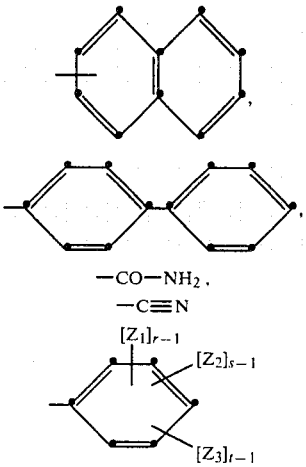

or $-CH_2-COOM_1$ or a mixture of a substituent of the formulae indicated for $Q_1$ and alkyl or alkenyl containing up to 4 carbon atoms, A is ethylene or n-propylene, $E_1$ is hydrogen, methyl or phenyl, $M_1$ is hydrogen or an alkali metal, or alkyl of 1 to 12 carbon atoms, $R_1$ and $R_2$ are alkyl of 1 to 4 carbon atoms or together with the nitrogen atom to which they are attached form a 5- or 6-membered ring which optionally contains an oxygen atom as second heteroatom, $T_1$ is alkyl, alkenyl, or aryl which contains up to 18 carbon atoms and is unsubstituted or substituted by alkyl or alkylene, $X_1\ominus$ is halogen, $Y_1$ and $Y_2$ are methyl or ethyl, $Z_1$, $Z_2$ and $Z_3$ are halogen, ethyl or methyl, and n, p, q, r, s and t are 1 or 2.

4. A process according to claim 1 in which the assistant contains a quaternary ammonium salt containing recurring units of the formula

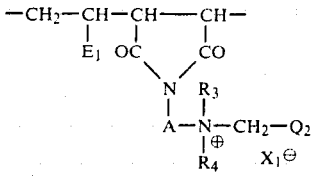

in which $Q_2$ is a substituent of the formulae

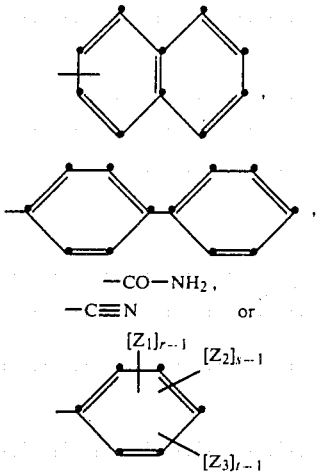

or a mixture of a substituent of the formulae indicated for $Q_2$ with alkyl or alkenyl containing up to 4 carbon atoms, and A is ethylene or n-propylene, $E_1$ is hydrogen, methyl or phenyl, $R_3$ and $R_4$ are methyl, ethyl, n-propyl or n-butyl or together with the nitrogen atom to which they are attached form a pyrrolidine, piperidine or morpholine radical, $X_1\ominus$ is halogen, $Y_1$ and $Y_2$ are methyl or ethyl, $Z_1$, $Z_2$ and $Z_3$ are halogen, methyl or ethyl, and r, s and t are 1 or 2.

5. A process according to claim 1, in which the assistant contains a quaternary ammonium salt containing recurring units of the formula

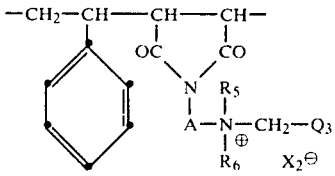

in which $Q_3$ is —CN, —CO—$NH_2$ or phenyl, A is ethylene or n-propylene, $X_2\ominus$ is chlorine or bromine and $R_5$ and $R_6$ are methyl, ethyl or n-propyl, or $R_5$ and $R_6$ together with the nitrogen atom to which they are attached form a morpholine radical.

6. A process according to claim 1 in which the assistant contains a quaternary ammonium salt containing recurring units of the formula

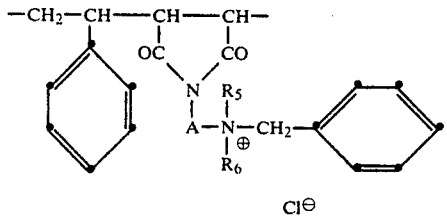

in which A is ethylene or n-propylene and $R_5$ and $R_6$ are methyl or ethyl.

7. A process according to claim 1, in which the assistant contains a quaternary ammonium salt containing recurring units of the formula

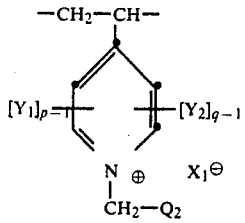

in which $X_1\ominus$, $Y_1$, $Y_2$, p and q are as defined in claim 3 and $Q_2$ is as defined in claim 4.

8. A process according to claim 1, in which the assistant contains a quaternary ammonium salt containing recurring units of the formula

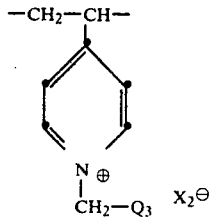

in which $X_2\ominus$ is chlorine or bromine and $Q_3$ is —CON, —CO—$NH_2$ or phenyl.

9. A process according to claim 1, in which the assistant contains a quaternary ammonium salt containing recurring units of the formula

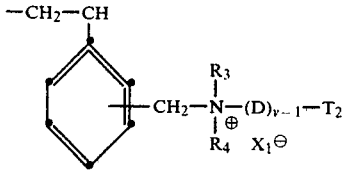

in which D is ethylene or methylene, $T_2$ is alkyl or aryl containing up to 18 carbon atoms which is unsubstituted or substituted by methyl or ethyl, v is 1 or 2, and $R_3$, $R_4$ and $X_1\ominus$ are as defined in claim 4.

10. A process according to claim 1, in which the assistant contains a quaternary ammonium salt containing recurring units of the formulae

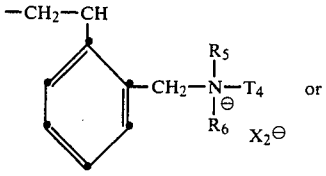

or

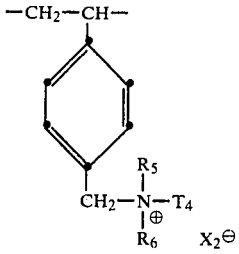

in which $T_4$ is naphthyl, benzyl or phenyl, $R_5$ and $R_6$ are ethyl or methyl, and $X_2\ominus$ is bromine or chlorine.

11. A process according to claim 1, in which the quaternary ammonium salt contained in the assistant has a molecular weight of 1500 to 1,000,000.

12. A process according to claim 1, in which the assistant is in the form of an aqueous or organic solution.

13. A process according to claim 1, which comprises the use of 0.01 to 5% of the assistant, calculated as pure ammonium salt, based on the weight of the fibrous material.

14. A process according to claim 1, which comprises the use of synthetic fibers of polyacrylonitrile, acrylonitrile copolymers, or of modified polyester or polyamide which can be dyed with cationic dyes, or of natural fibers of cellulose.

15. A process according to claim 1, in which the fibrous material is dyed or printed with a preparation which is in the form of an aqueous or aqueous-organic solution, dispersion, printing paste or printing ink, and which contains a dye.

16. A process according to claim 1, in which the fibrous material is dyed by the exhaust method in the presence of the dyeing assistant as defined in claim 1.

17. A process according to claim 1, in which the fibrous material is printed patchwise, before dyeing, with an aqueous printing paste which contains the printing assistant as defined in claim 1.

18. An aqueous preparation for carrying out the process according to claim 1, which conains a cationic dye and the assistant as defined in claim 1.

* * * * *